US012041970B2

(12) United States Patent
Yoon

(10) Patent No.: US 12,041,970 B2
(45) Date of Patent: Jul. 23, 2024

(54) AEROSOL GENERATING DEVICE AND AEROSOL GENERATING SYSTEM

(71) Applicant: KT&G CORPORATION, Daejeon (KR)

(72) Inventor: Sung Wook Yoon, Seoul (KR)

(73) Assignee: KT&G CORPORATION, Daejeon (KR)

( * ) Notice: Subject to any disclaimer, the term of this patent is extended or adjusted under 35 U.S.C. 154(b) by 979 days.

(21) Appl. No.: 16/982,335

(22) PCT Filed: May 8, 2020

(86) PCT No.: PCT/KR2020/006112
§ 371 (c)(1),
(2) Date: Sep. 18, 2020

(87) PCT Pub. No.: WO2020/226458
PCT Pub. Date: Nov. 12, 2020

(65) Prior Publication Data

US 2023/0108821 A1 Apr. 6, 2023

(30) Foreign Application Priority Data

May 8, 2019 (KR) ..... 10-2019-0053897

(51) Int. Cl.
*A24F 40/485* (2020.01)
*A24F 40/20* (2020.01)
(Continued)

(52) U.S. Cl.
CPC ..... *A24F 40/485* (2020.01); *A24F 40/20* (2020.01); *A24F 40/57* (2020.01); *A24F 40/51* (2020.01); *A24F 40/85* (2020.01)

(58) Field of Classification Search
CPC ..... A24F 40/485; A24F 40/20; A24F 40/57; A24F 40/51; A24F 40/85; A24F 40/46;
(Continued)

(56) References Cited

U.S. PATENT DOCUMENTS 4,184,496 A 1/1980 Adair
6,095,153 A 8/2000 Kessler et al.
(Continued)

FOREIGN PATENT DOCUMENTS

CN 104095295 A 10/2014
JP 2000-245430 A 9/2000
(Continued)

OTHER PUBLICATIONS

Extended European Search Report issued Nov. 5, 2021 in European Application No. 20771178.9.
(Continued)

*Primary Examiner* — Travis S Chambers
(74) *Attorney, Agent, or Firm* — Sughrue Mion, PLLC

(57) ABSTRACT

An aerosol generating device includes a housing having an opening through which a cigarette is inserted and including a cavity formed therein, a heater heating the cigarette to generate an aerosol, an air flow channel in fluid communication with the outside of the housing to supply air to the cigarette, and an air circulation device arranged in the air flow channel to generate airflow in the air flow channel.

15 Claims, 7 Drawing Sheets

(51) Int. Cl.
*A24F 40/57* (2020.01)
*A24F 40/51* (2020.01)
*A24F 40/85* (2020.01)

(58) Field of Classification Search
CPC ..... A24F 40/40; A24F 40/50; A24B 15/16; H05B 1/02; H05B 3/00; H05B 2203/03
See application file for complete search history.

(56) References Cited

U.S. PATENT DOCUMENTS

| | | | | |
|---|---|---|---|---|
| 11,559,081 | B2 * | 1/2023 | Blick | A61M 11/042 |
| 2004/0149737 | A1 * | 8/2004 | Sharpe | A24F 40/465 219/635 |
| 2009/0095287 | A1 | 4/2009 | Emarlou | |
| 2013/0247910 | A1 | 9/2013 | Postma | |
| 2014/0338686 | A1 | 11/2014 | Plojoux et al. | |
| 2015/0128971 | A1 * | 5/2015 | Verleur | H02J 7/0042 131/329 |
| 2015/0230522 | A1 * | 8/2015 | Horn | A24F 40/40 131/329 |
| 2018/0049472 | A1 | 2/2018 | Mahler et al. | |
| 2018/0064168 | A1 | 3/2018 | Hurwitz | |
| 2018/0085551 | A1 * | 3/2018 | Krietzman | H05B 1/0252 |
| 2020/0038601 | A1 * | 2/2020 | Hepworth | A61M 15/06 |
| 2020/0086068 | A1 | 3/2020 | Lee et al. | |
| 2020/0120978 | A1 | 4/2020 | Malgat et al. | |

FOREIGN PATENT DOCUMENTS

| | | | |
|---|---|---|---|
| KR | 10-2012-0082641 | A | 7/2012 |
| KR | 10-2016-0096590 | A | 8/2016 |
| KR | 10-2016-0109073 | A | 9/2016 |
| KR | 10-1679489 | B1 | 11/2016 |
| KR | 10-2018-0070455 | A | 6/2018 |
| WO | 2013/083635 | A1 | 6/2013 |
| WO | 2018-141466 | A1 | 8/2018 |

OTHER PUBLICATIONS

Office Action issued Jan. 4, 2022 in Japanese Application No. 2020-554173.

Chinese Office Action dated Apr. 24, 2023 in Chinese Application No. 202080001897.3.

International Search Report dated Oct. 27, 2020 issued by the Korean Intellectual Property Office in Application No. PCT/KR2020/006112.

Communication dated Oct. 16, 2020 issued by the Korean Intellectual Property Office in Korean Application No. 10-2019-0053897.

European Office Action issued Nov. 10, 2023 in Application No. 20 771 178.9.

* cited by examiner

[Fig. 1]
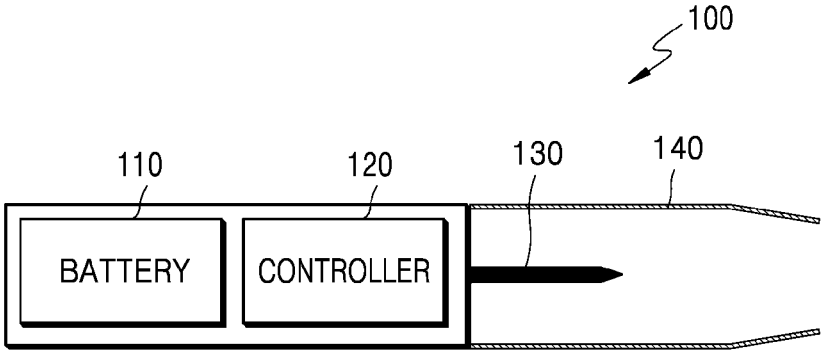
[Fig. 2]
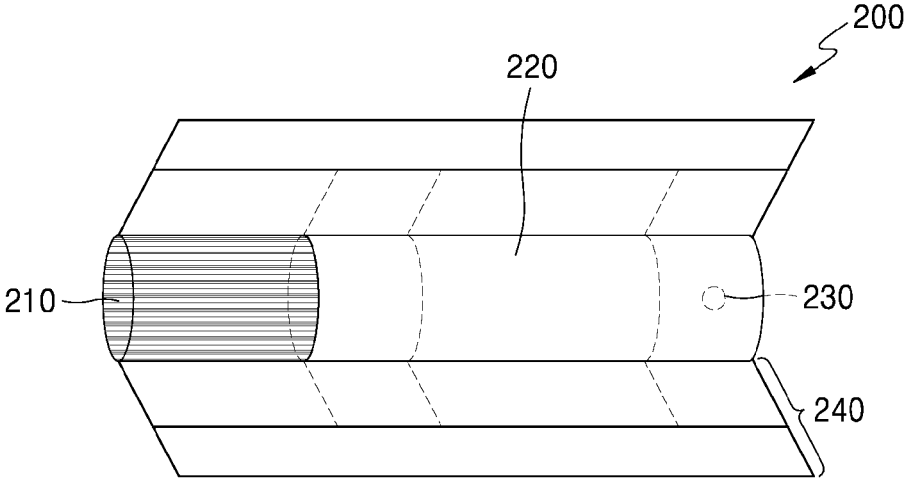

[Fig. 3]
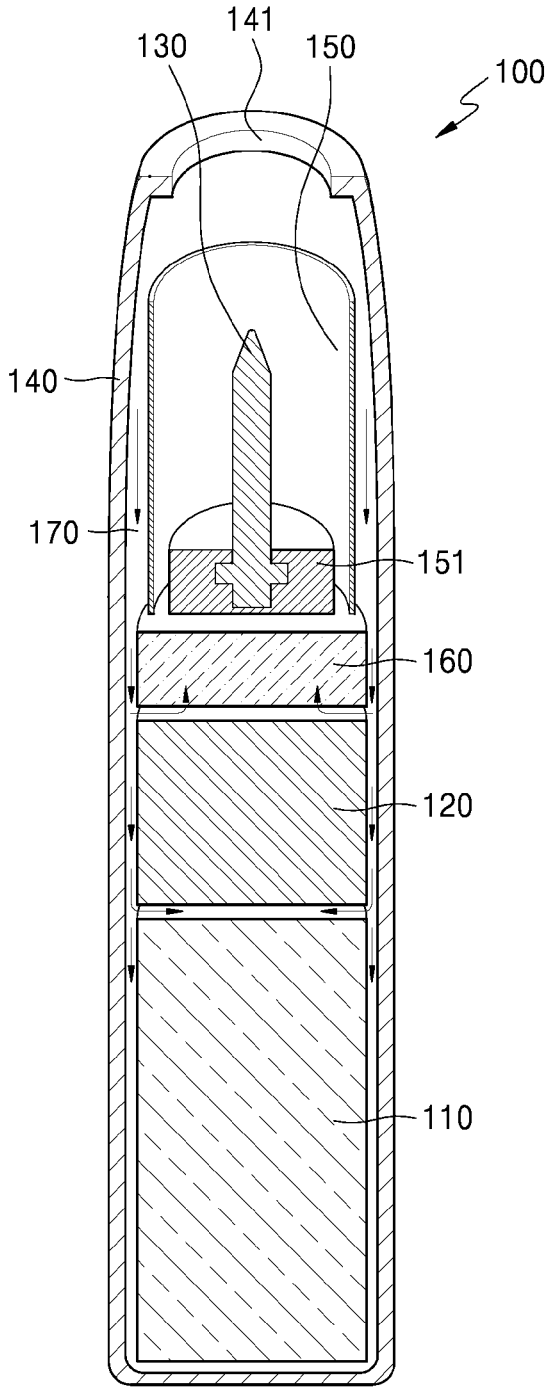

[Fig. 4]
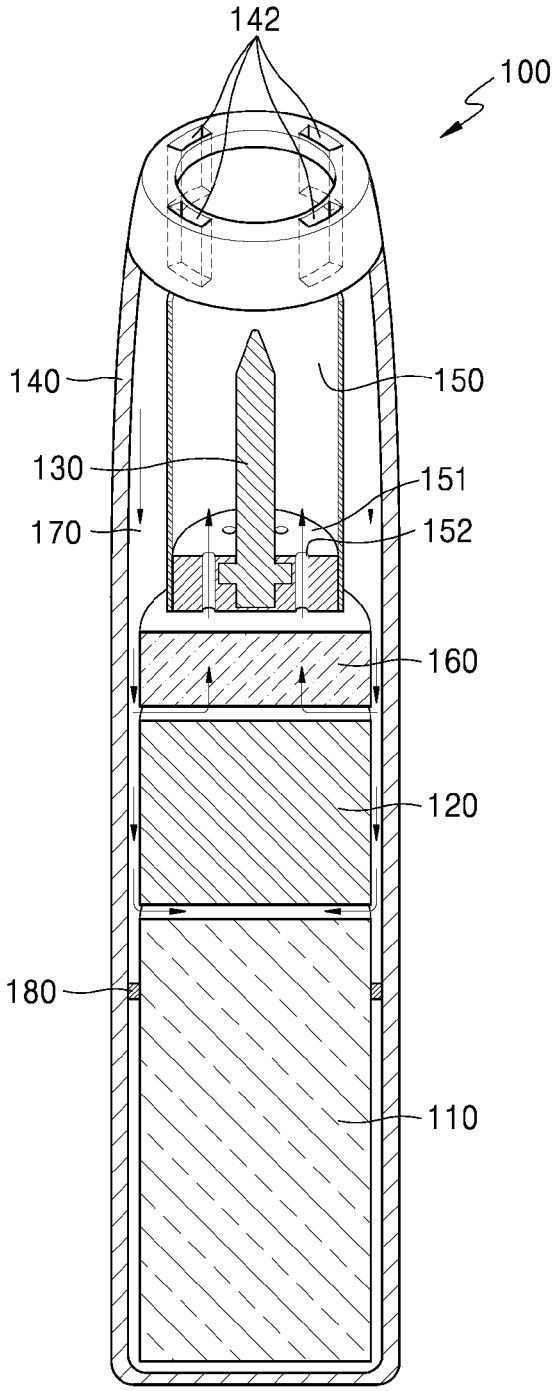

[Fig. 5]
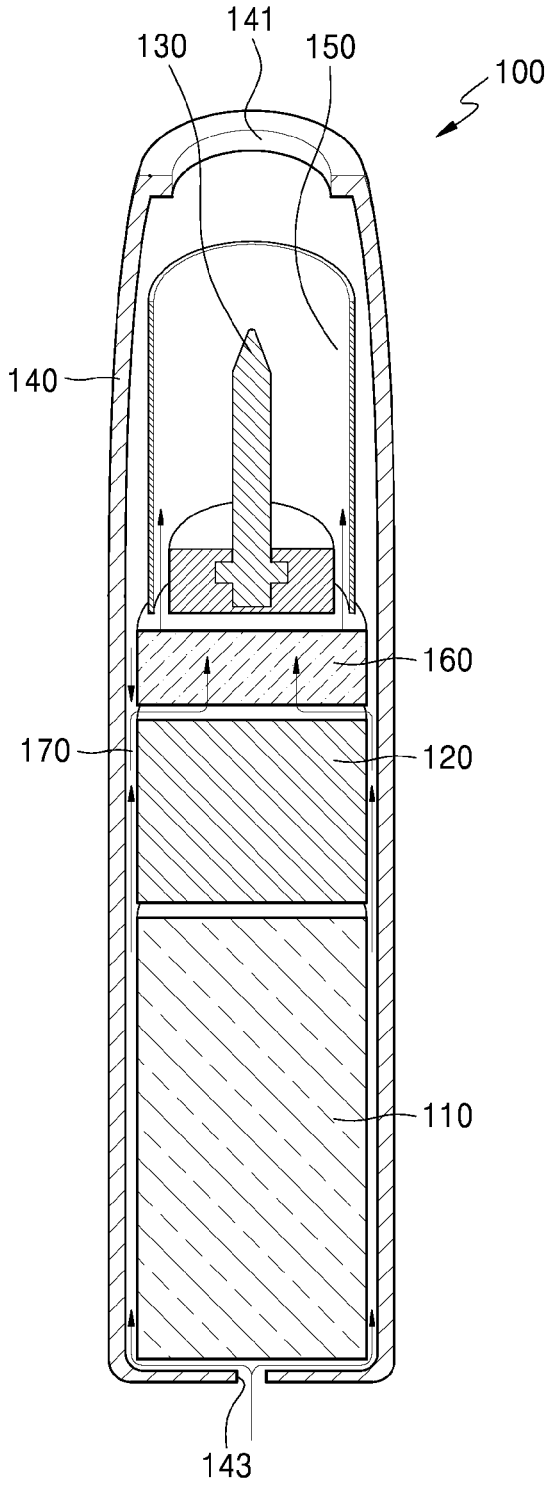

[Fig. 6]
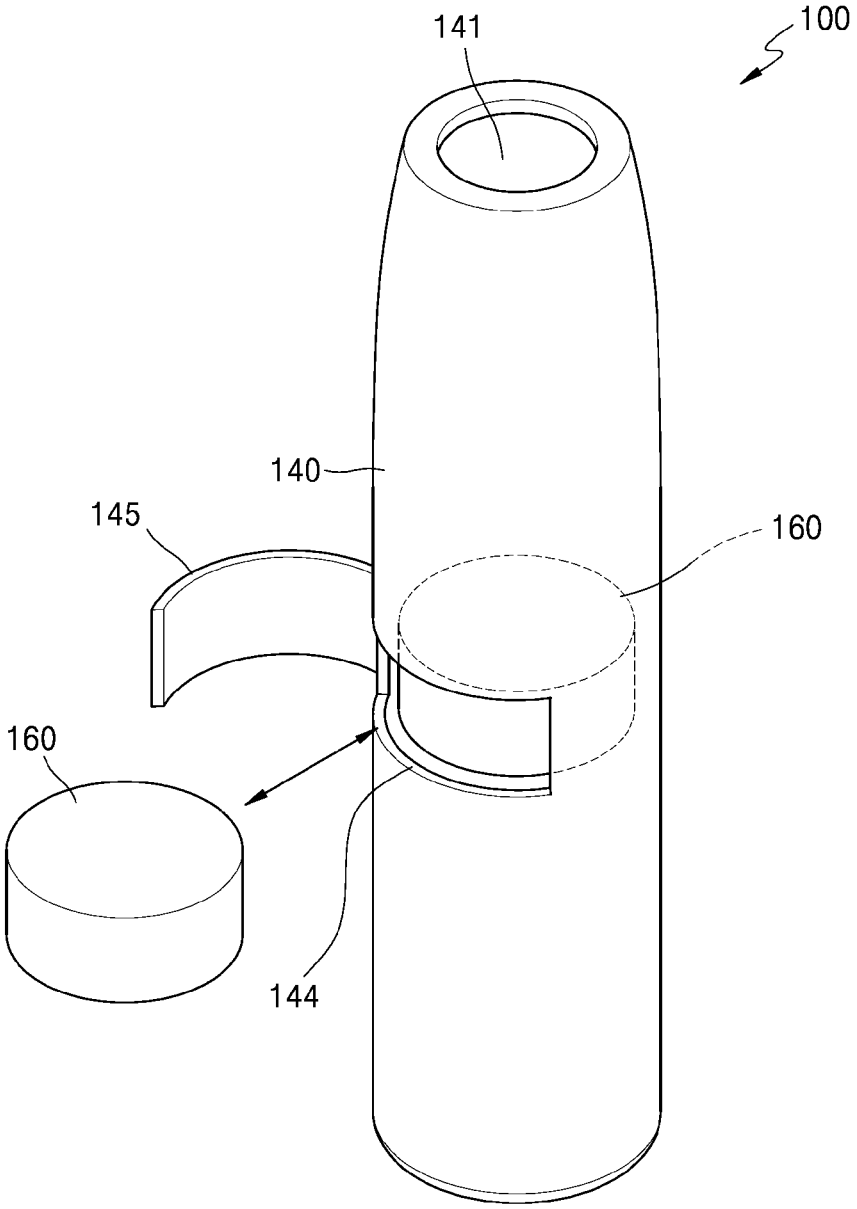

[Fig. 7]
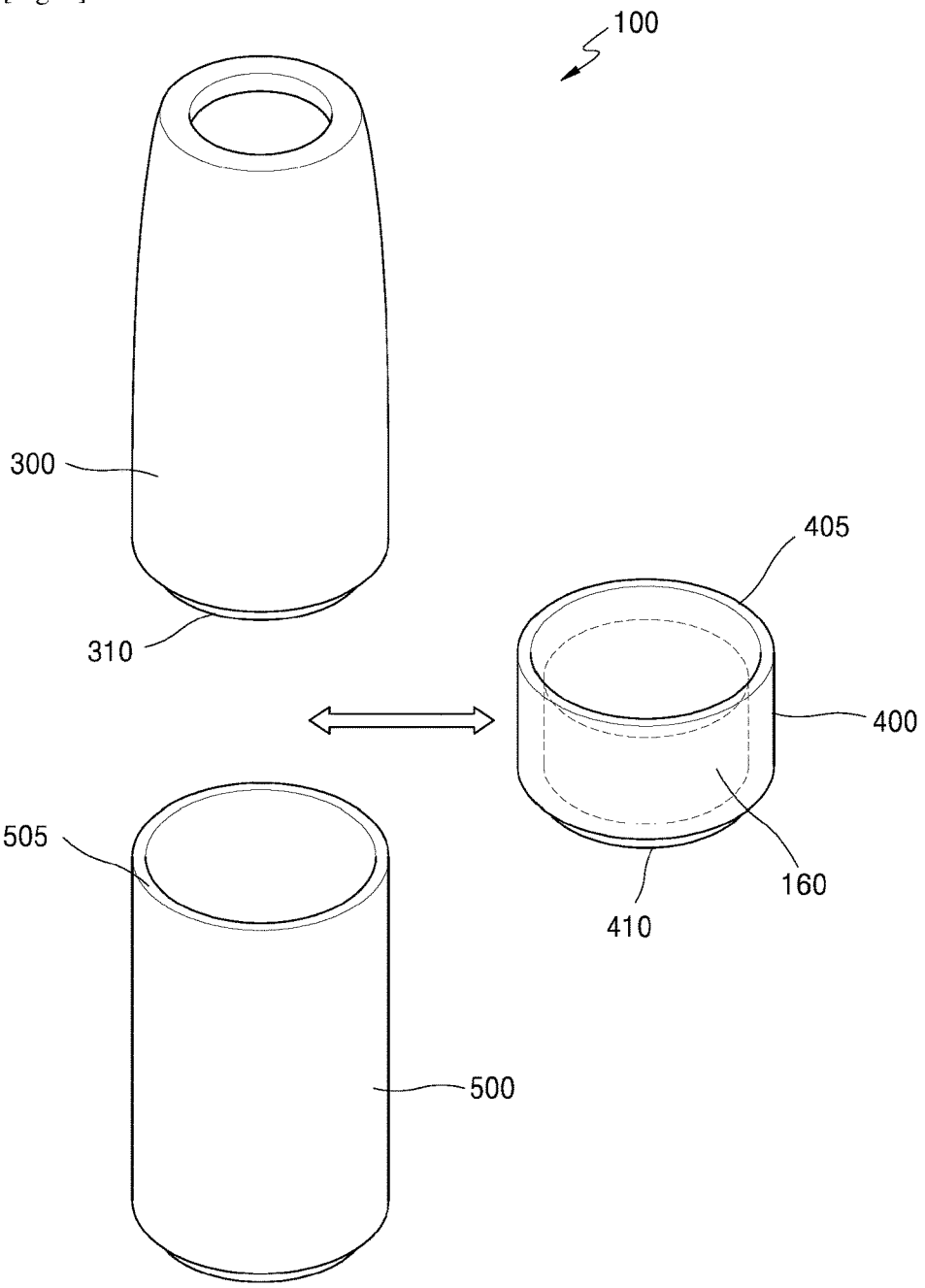
[Fig. 8]
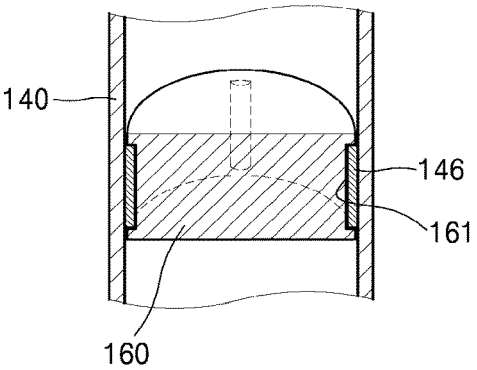

[Fig. 9]
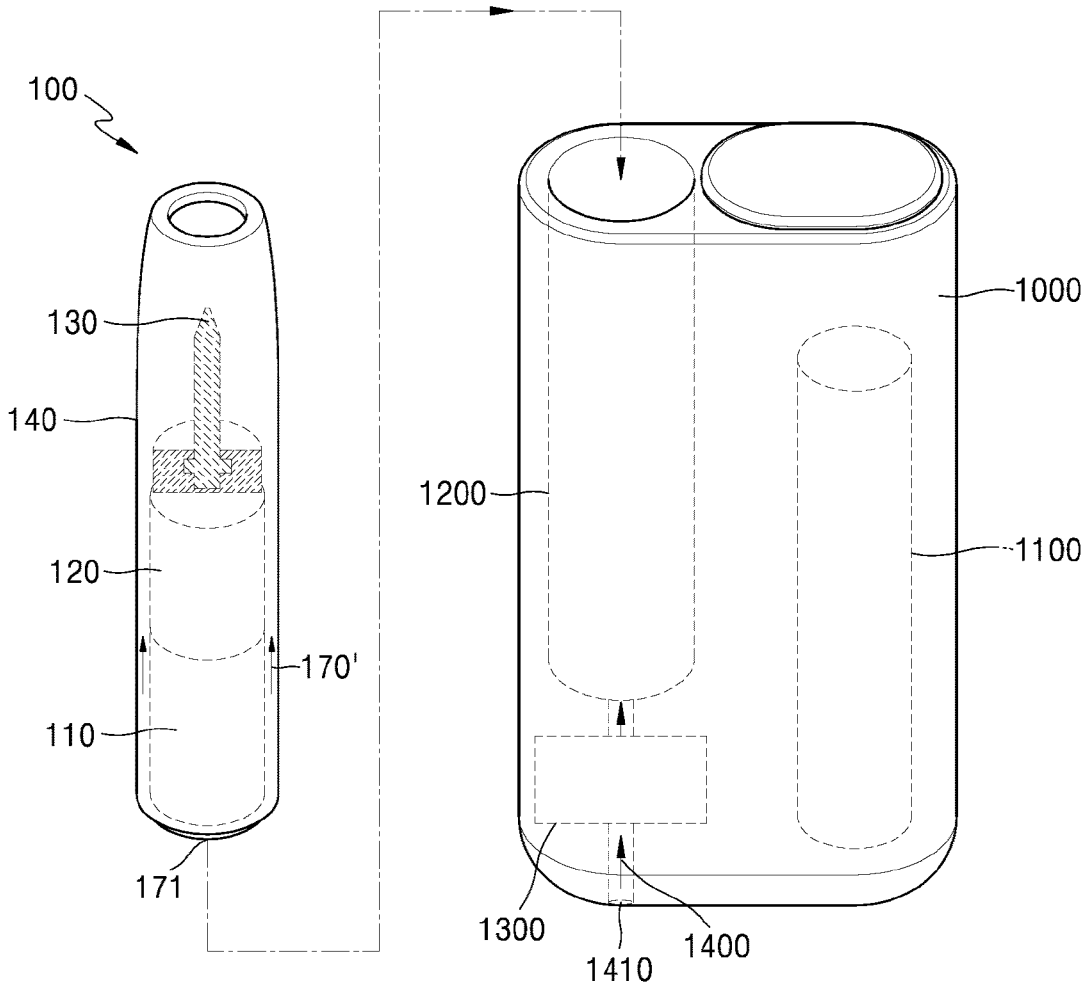

AEROSOL GENERATING DEVICE AND AEROSOL GENERATING SYSTEM

CROSS REFERENCE TO RELATED APPLICATIONS

This application is a National Stage of International Application No. PCT/KR2020/006112 filed May 8, 2020, claiming priority based on Korean Patent Application No. 10-2019-0053897 filed May 8, 2019.

TECHNICAL FIELD

One or more embodiments relate to an aerosol generating device and an aerosol generating system, and more particularly, to an aerosol generating device and an aerosol generating system which include an air circulation device.

BACKGROUND ART

Recently, the demand for an alternative to traditional cigarettes has increased. For example, there is growing demand for an aerosol generating device that generates aerosol by heating an aerosol generating material contained in an aerosol generating article (e.g., a cigarette), rather than by combusting cigarettes. Accordingly, studies on a heating-type cigarette and a heating-type aerosol generating device have been actively conducted.

In general, an aerosol generating device includes an air flow passage. A flow rate of air flowing through the air flow passage is directly related to the inhalation resistance of the aerosol generating device. Also, this greatly affects the amount of smoke in cigarettes. Therefore, an air flow passage that is an important element of an aerosol generating device. However, it is very difficult to design an air flow passage to have an appropriate flow rate of air by arrangements of components of the aerosol generating device. Also, it is difficult for the user to adjust a flow rate of air during smoking.

DISCLOSURE

Technical Solution

One or more embodiments include an aerosol generating device and an aerosol generating system. One or more embodiments include an aerosol generating device and an aerosol generating system capable of adjusting a flow rate of air flowing through an air flow passage by installing an air circulation device in the air flow passage.

The problems to be solved through embodiments are not limited to the problems described above, and unmentioned problems may be clearly understood by those of ordinary skill in the art from the present specification and the accompanying drawings.

According to one or more embodiments, an aerosol generating device includes a housing having an opening into which a cigarette is inserted and including a cavity formed therein, a heater heating the cigarette to generate an aerosol, an air flow channel in fluid communication with the outside of the housing to supply air to the cigarette, and an air circulation device arranged in the air flow channel to generate airflow in the air flow channel.

Advantageous Effects

An aerosol generating device according to one or more embodiments may adjust a flow rate of air supplied to an accommodation space by adjusting a flow rate of air flowing through an air flow passage by an air circulation device. Therefore, the aerosol generating device may adjust the amount and smoothness of aerosol during smoking.

A user may operate the air circulation device to remove a residue of a cigarette that may remain in an accommodation space of the cigarette after the cigarette is used. Since external air may be introduced into the accommodation space by the air circulation device, the accommodation space may be ventilated.

Since an air flow channel is formed between a battery and a controller that may be heated during use, the battery and the controller may be cooled by airflow in the air flow channel. Also, since air flowing into the accommodation space through the battery and the controller may receive heat from the battery and the controller and a temperature is elevated, the amount of heat transferred from a heater to the air in the accommodation space may be reduced. Therefore, heat loss occurring in the heater may be reduced.

The effects achieved by the embodiments are not limited to the effects described above, and unmentioned effects may be clearly understood by those of ordinary skill in the art from the present specification and the accompanying drawings.

DESCRIPTION OF DRAWINGS

FIG. 1 is a cross-sectional view schematically illustrating an aerosol generating device according to an embodiment.

FIG. 2 is an exploded view schematically illustrating a cigarette heated by the aerosol generating device according to an embodiment.

FIG. 3 is a cross-sectional view schematically illustrating an aerosol generating device according to an embodiment.

FIG. 4 is a cross-sectional view schematically illustrating an aerosol generating device according to another embodiment.

FIG. 5 is a cross-sectional view schematically illustrating an aerosol generating device according to yet another embodiment.

FIG. 6 is a perspective view schematically illustrating a detachable air circulation device according to an embodiment.

FIG. 7 is a perspective view schematically illustrating a detachable air circulation device according to another embodiment.

FIG. 8 is a cross-sectional view schematically illustrating a fixed structure of an air circulation device according to an embodiment.

FIG. 9 is a perspective view schematically illustrating an aerosol generating system including an aerosol generating device and a cradle, according to an embodiment.

BEST MODE

According to one or more embodiments, an aerosol generating device includes a housing having an opening into which a cigarette is inserted and including a cavity formed therein, a heater heating the cigarette to generate an aerosol, an air flow channel in fluid communication with the outside of the housing to supply air to the cigarette, and an air circulation device arranged in the air flow channel to generate airflow in the air flow channel.

The aerosol generating device may further include a base supporting the heater and a case arranged in the cavity to form an accommodation space accommodating at least a portion of the cigarette together with the base, wherein the air flow channel provides fluid communication between the outside of the housing and the accommodation space.

The air circulation device may be arranged to face the base to generate airflow toward the accommodation space.

The air flow channel may include an air inlet formed around the opening of the housing and an air flow passage providing fluid communication between the air inlet and the air circulation device.

The aerosol generating device may further include a battery supplying power to the heater and the air circulation device and a controller controlling an operation of the heater and driving of the air circulation device.

The air flow channel may include an air flow passage passing by the battery and the controller.

The air flow channel may further include an air inlet formed at an end opposite to an end having the opening of the housing.

The controller may control the heater and the air circulation device independently.

The air circulation device may be detached from the aerosol generating device.

The air circulation device may be a sub-assembly including a terminal for receiving power, and, when the air circulation device is coupled to the aerosol generating device, the aerosol generating device may be electrically connected to the terminal of the air circulation device to supply power to the air circulation device.

The housing may include an insertion opening through which the air circulation device is inserted, and the air circulation device may be assembled into or disassembled from the aerosol generating device through the insertion opening.

The housing may include an internal space accommodating the air circulation device, and the internal space may include a fixing portion fixing the air circulation device.

The fixing portion may include any one of a protrusion supporting the air circulation device and a groove engaging with the protrusion, and the air circulation device may include the other one of the protrusion and the groove.

The fixing portion may form a point contact or a line contact with the air circulation device.

The fixing portion may have elasticity.

The aerosol generating device may further include an extractor arranged in the accommodation space and detachable from the accommodate space, wherein the air circulation device located between the extractor and the base to supply air into the extractor.

According to one or more embodiments, an aerosol generating device includes a first sub-assembly including a first housing having an opening through which a cigarette is inserted and including a cavity formed therein and a heater heating the cigarette to generate aerosol, a second sub-assembly including an air circulation device generating airflow, and a third sub-assembly including a battery supplying power to the heater and the air circulation device and a controller controlling an operation of the heater and driving of the air circulation device, wherein the first, second, and third sub-assemblies respectively include connection portions through which the first, second, and third sub-assemblies are assembled with one another, and, when the first, second, and third sub-assemblies are assembled with one another, the first, second, and third sub-assemblies are electrically connected to one another and form an air flow channel in fluid communication with the outside of the housing to supply air to the cigarette, and the air circulation device is arranged in the air flow channel to generate an air flow in the air flow channel.

According to one or more embodiments, an aerosol generating system includes an aerosol generating device and a cradle accommodating the aerosol generating device and charging a battery of the aerosol generating device, wherein the aerosol generating device includes a housing having an opening through which a cigarette is inserted and including a cavity formed therein, a heater heating the cigarette to generate aerosol, and a first air flow channel in fluid communication with the outside of the housing to supply air to the cigarette, and the cradle includes a second air flow channel in fluid communication with the first air flow channel of the aerosol generating device and an air circulation device arranged in the second air flow channel to generate airflow in the first air flow channel.

The aerosol generating device may further include a base supporting the heater and a case arranged in the cavity to form an accommodation space accommodating at least a portion of the cigarette together with the base, wherein the first air flow channel provides fluid communication between the second air flow channel and the accommodation space.

The first air flow channel may include a first air inlet formed at an end opposite to an end having the opening of the housing and an air flow passage communicating with the first air inlet and communicating with an interior of the accommodation space.

The aerosol generating device may further include a battery supplying power to the heater and the air circulation device and a controller controlling an operation of the heater and driving of the air circulation device, wherein the air flow passage passes by the battery and at least a portion of the controller.

MODE FOR INVENTION

With respect to the terms in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Throughout the specification, an aerosol generating device may be a device that heats an aerosol generating material to generate aerosol that may be directly inhaled into lugs of a user through the mouth of the user. For example, the aerosol generating device may be a holder.

Throughout the specification, "puff" may refer to the inhalation of a user, and the "inhalation" may refer to an action in which the mouth or nose of the user pulls air into the oral cavity, nasal cavity, or lungs of the user.

Also, it is assumed that a cigarette is used as an aerosol generating article containing an aerosol generating material. However, an aerosol generating material may be provide in any other types of an aerosol generating article that may be coupled to an aerosol generating device.

Hereinafter, the present disclosure will now be described more fully with reference to the accompanying drawings, in which example embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

An aerosol generating device 100 and a cigarette 200 will now be described in detail with reference to FIGS. 1 and 2.

FIG. 1 is a cross-sectional view schematically illustrating the aerosol generating device 100 according to an embodiment. Referring to FIG. 1, the aerosol generating device 100 includes a battery 110, a controller 120, a heater 130, and a housing 140.

FIG. 1 shows the aerosol generating device 100 with some elements related to the embodiment. Therefore, it will be understood by one of ordinary skill in the art related to the present embodiment that other components may be further included in the aerosol generating device 100, in addition to the components illustrated in FIG. 1.

FIG. 1 illustrates that the battery 110, the controller 120, and the heater 130 are arranged in series, but the arrangement of these are not limited thereto. In other words, according to the design of the aerosol generating device 100, the arrangement of the battery 110, the controller 120, and the heater 130 may be modified.

When the cigarette 200 is inserted into the aerosol generating device 100, the aerosol generating device 100 heats the heater 130. The temperature of an aerosol generating material in the cigarette 200 is raised by the heated heater 130, and thus aerosol is generated. The generated aerosol is delivered to a user through a filter 220 of the cigarette 200.

As necessary, even when the cigarette 200 is not inserted into the aerosol generating device 100, the aerosol generating device 100 may heat the heater 130.

The battery 110 may supply power to be used for the aerosol generating device 100 to operate. For example, the battery 110 may supply power for heating the heater 130 and supply power for operating the controller 120. Also, the battery 110 may supply power for operations of a display, a sensor, a motor, etc. mounted in the aerosol generating device 100. For example, the battery 110 may be a lithium ion battery, a nickel-based battery (e.g., a nickel-metal hydride battery, a nickel-cadmium battery, or the like), or a lithium-based battery (e.g., a lithium-cobalt battery, a lithium-phosphate battery, a lithium titanate battery, or a lithium-polymer battery).

The controller 120 may control overall operations of the aerosol generating device 100. In detail, the controller 120 controls not only operations of the battery 110 and the heater, but also operations of other components included in the aerosol generating device 100. Also, the controller 120 may check a state of each of the components of the aerosol generating device 100 to determine whether or not the aerosol generating device 100 is able to operate.

Also, the controller 120 may control an air circulation device 160 that will be described later and may control only the air circulation device 160 separately from the control of the battery 110 and the heater 130. Therefore, a user may operate only the air circulation device 160 after using the aerosol generating device 100. A residue of a cigarette that may remain in an accommodation space after the cigarette is used may be removed by the operation of the air circulation device 160. Also, since external air is introduced into the accommodation space, the accommodation space may be ventilated.

The controller 120 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 130 may be heated by power supplied from the battery 110 and may heat the cigarette 200 inserted into the aerosol generating device 100. The cigarette 200 may be inserted into the aerosol generating device 100 by the user, and the inserted cigarette 200 may contact the heater 130.

For example, when the cigarette 200 is inserted into the aerosol generating device 100, the heater 130 may be located inside the cigarette 200. Thus, the heated heater 130 may increase a temperature of an aerosol generating material in the cigarette 200.

The heater 130 may include an electro-resistive heater. For example, the heater 130 may include an electrically conductive track, and the heater 130 may be heated when currents flow through the electrically conductive track. However, the heater 130 is not limited to the example described above and may be implemented using any other heaters capable of being heated to a desired temperature. Here, the desired temperature may be pre-set in the aerosol generating device 50 or may be set by a user.

As another example, the heater 130 may include an induction heater. In detail, the heater 130 may include an electrically conductive coil for heating a cigarette by an induction heating method, and the cigarette may include a susceptor which may be heated by the induction heater.

In FIG. 1, the heater 130 is illustrated as being a needle-shaped type and being arranged along the longitudinal axis of the aerosol generating device 100, but the shape and arrangement of the heater 130 are not limited thereto. For example, the heater 130 may include a tube-type heating element, a plate-type heating element, a needle-type heating element, or a rod-type heating element, and may heat the inside or the outside of the cigarette 200, according to the shape of the heating element.

Also, the aerosol generating device 100 may include a plurality of heaters 130. Here, the plurality of heaters 130 may be inserted into the cigarette 200 or may be arranged outside the cigarette 200. Also, some of the plurality of heaters 130 may be inserted into the cigarette 200, and the others may be arranged outside the cigarette 200. In addition, the shape of the heater 130 is not limited to the shape illustrated in FIG. 1, and may include various shapes.

The housing 140 forms an exterior of the aerosol generating device 100 and accommodates and protects various elements in a space formed therein. The housing 140 has a hollow cylindrical shape that includes an opening 141 (refer to FIG. 3) through which the cigarette 200 may be inserted.

The housing 140 may be formed of a plastic material or a metallic material coated with a plastic material such that housing 140 does not transmit electricity or heat. In FIG. 1, the housing 140 has a cylindrical shape having a circular cross section, but the embodiment is not limited thereto. For example, the housing 140 may have a cylindrical shape having a polygonal cross section such as a square.

The aerosol generating device 100 may further include other components in addition to the battery 110, the controller 120, and the heater 130. For example, the aerosol generating device 100 may include a display capable of outputting visual information and/or a motor for outputting haptic information. Also, the aerosol generating device 100 may include at least one sensor (e.g., a puff detecting sensor, a temperature detecting sensor, a cigarette insertion detecting sensor, etc.).

Also, the aerosol generating device 100 may be formed as a structure where, even when the cigarette 200 is inserted into the aerosol generating device 100, external air may be introduced or internal air may be discharged.

The cigarette 200 may be similar to a general combustive cigarette. For example, the cigarette 200 may be divided into a first portion 210 including an aerosol generating material and a second portion 220 including a filter or the like. Alternatively, the second portion 220 of the cigarette 200 may also include an aerosol generating material. For example, an aerosol generating material made in the form of granules or capsules may be inserted into the second portion 220.

The first portion 210 may be completely inserted into the aerosol generating device 100, and the second portion 220 may be exposed to the outside. In some embodiments, only a portion of the first portion 210 may be inserted into the aerosol generating device 100. Alternatively, a portion of the first portion 210 and a portion of the second portion 220 may be inserted into the aerosol generating device 100. The user may puff aerosol while holding the second portion 220 by the mouth of the user. In this case, the aerosol is generated by the external air passing through the first portion 210, and the generated aerosol passes through the second portion 220 and is delivered to the user's mouth.

For example, the external air may flow into at least one air passage formed in the aerosol generating device 100. For example, opening and closing of the air passage and/or a size of the air passage may be adjusted by the user. Accordingly, the amount and smoothness of smoke may be adjusted by the user. As another example, the external air may flow into the cigarette 200 through at least one hole formed in a surface of the cigarette 200.

FIG. 2 schematically illustrates a cigarette heated by an aerosol generating device according to an embodiment.

Referring to FIG. 2, the cigarette 200 includes a tobacco rod 210 and a filter rod 220. The first portion 210 described above with reference to FIG. 1 includes the tobacco rod 210, and the second portion 220 includes the filter rod 220.

The filter rod 220 illustrated in FIG. 2 is illustrated as a single segment, but is not limited thereto. In other words, the filter rod 220 may include a plurality of segments. For example, the filter rod 220 may include a first segment configured to cool aerosol and a second segment configured to filter a certain component included in the aerosol. Also, as necessary, the filter rod 220 may further include at least one segment configured to perform other functions.

The cigarette 200 may be packaged using at least one wrapper 240. The wrapper 240 may have at least one hole through which external air may be introduced or internal air may be discharged. For example, the cigarette 200 may be packaged using one wrapper 240. As another example, the cigarette 200 may be doubly packaged using at least two wrappers 240. For example, the tobacco rod 210 may be packaged using a first wrapper, and the filter rod 220 may be packaged using a second wrapper. Also, the tobacco rod 210 and the filter rod 220, which are respectively packaged using separate wrappers, may be coupled to each other, and the entire cigarette 200 may be packaged using a third wrapper. When each of the tobacco rod 210 and the filter rod 220 includes a plurality of segments, each segment may be packaged using a separate wrapper. Also, the entire cigarette 200 including the plurality of segments, which are respectively packaged using the separate wrappers and which are coupled to each other, may be re-packaged using another wrapper.

The tobacco rod 210 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 210 may include other additives, such as flavors, a wetting agent, and/or organic acid. Also, the tobacco rod 210 may include a flavored liquid, such as menthol or a moisturizer, which is injected to the tobacco rod 210.

The tobacco rod 210 may be manufactured in various forms. For example, the tobacco rod 210 may be formed as a sheet or a strand. Also, the tobacco rod 210 may be formed as a pipe tobacco, which is formed of tiny bits cut from a tobacco sheet. Also, the tobacco rod 210 may be surrounded by a heat conductive material. For example, the heat-conducting material may be, but is not limited to, a metal foil such as aluminum foil. For example, the heat conductive material surrounding the tobacco rod 210 may uniformly distribute heat transmitted to the tobacco rod 210, and thus, the heat conductivity applied to the tobacco rod may be increased and taste of the tobacco may be improved. Also, the heat conductive material surrounding the tobacco rod 210 may function as a susceptor heated by the induction heater. Here, although not illustrated in the drawings, the tobacco rod 210 may further include an additional susceptor, in addition to the heat conductive material surrounding the tobacco rod 210.

The filter rod 220 may include a cellulose acetate filter. Shapes of the filter rod 220 are not limited. For example, the filter rod 220 may include a cylinder-type rod or a tube-type rod having a hollow inside. Also, the filter rod 220 may include a recess-type rod having a cavity inside. When the filter rod 220 includes a plurality of segments, at least one of the plurality of segments may have a different shape.

The filter rod 220 may be formed to generate flavors. For example, a flavoring liquid may be injected onto the filter rod 220, or an additional fiber coated with a flavoring liquid may be inserted into the filter rod 220.

Also, the filter rod 220 may include at least one capsule 230. Here, the capsule 230 may generate a flavor or aerosol. For example, the capsule 230 may have a configuration in which a liquid containing a flavoring material is wrapped with a film. For example, the capsule 230 may have a spherical or cylindrical shape, but is not limited thereto.

When the filter rod 220 includes a segment configured to cool the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above-described example and any other cooling segment that is capable of cooling the aerosol may be used.

Although not illustrated in FIG. 2, the cigarette 200 may further include a front-end plug. The front-end plug may be located on a side of the tobacco rod 210, the side not facing the filter rod 220. The front-end plug may prevent the tobacco rod 210 from being detached from the cigarette 200 and prevent the liquefied aerosol from flowing into the aerosol generating device 100 from the tobacco rod 210, during smoking.

FIG. 3 is a cross-sectional view schematically illustrating an aerosol generating device according to an embodiment. Hereinafter, detailed description about components of the aerosol generating device 100 which have been described above will be omitted.

Referring to FIG. 3, an aerosol generating device 100 includes a case 150, a base 151, an air circulation device 160, and an air flow channel 170.

The case 150 may be arranged in a cavity formed inside a housing 140, and the base 151 may support the heater 130. An accommodation space that accommodates at least a portion of the cigarette may be formed by the case 150 and the base 151.

The air circulation device 160 may be arranged in the air flow channel 170 to have air flow along the air flow channel 170. For example, the air circulation device 160 may include a device capable of generating airflow, such as a fan and an air pump.

As in the embodiment illustrated in FIG. 3, the air circulation device 160 may be arranged to face the base 151 supporting the heater 130. The air circulation device 160 may generate airflow in the air flow channel 170, and the amount of air supplied to the accommodation space may be adjusted by adjusting a flow rate of air through the air circulation device 160. After use of the aerosol generating device 100 is completed, only the air circulation device 160 may operate to ventilate the accommodation space of the aerosol generating device 100 and maintain cleanliness. The position where the air circulation device 160 is arranged is not limited by the above description, and the air circulation device 160 may be arranged in a position capable of generating airflow. For example, the aerosol generating device 100 may further include an extractor that is arranged in the accommodation space and is detachable from the accommodation space. the extractor may extract the aerosol generating article accommodated in the aerosol generating device. In this case, the air circulation device 160 may be arranged between the extractor and the base 151 to supply air into the extractor.

The air flow channel 170 includes a passage through which air introduced from the outside of the housing 140 flows. The air flow channel 170 may include an air flow passage formed by a gap between components arranged inside the housing 140. For example, the air flow channel 170 may be formed between an inner wall of the housing 140 and an outer wall of the case 150. Air introduced from the outside may flow into the accommodation space by flowing along the air flow channel 170 formed between the inner wall of the housing 140 and the outer wall of the case 150.

Also, the air flow channel 170 may include air flow passages formed between components such as the inner wall of the housing 140, the air circulation device 160, a controller 120, and a battery 110. As illustrated in arrows illustrated in FIG. 3, air introduced from the outside may form airflow between the components such as the battery 110 and the controller 120. Therefore, the air flow channel 170 may communicate with the accommodation space through the air passages.

Commonly, the battery 110 and the controller 120 of the aerosol generating device 100 may be heated by an operation of the aerosol generating device 100. For example, a temperature of circuit boards of the battery 110 and the controller 120 often increases to about 90° C. Therefore, the battery 110 and the controller 120 need to be prevented from overheating. In the embodiment illustrated in FIG. 3, since the air flow channel 170 may be formed beside components of the aerosol generating device 100, in particular, the battery 110 and the controller 120, the battery 110 and the controller 120 may be cooled by the airflow in the air flow channel 170.

Also, since air flowing beside the battery 110 and the controller 120 may receive heat from the battery 110 and the controller 120, air before entering the accommodation space may have a higher temperature than external air. Therefore, the amount of heat transferred from the heater 130 to air in the accommodation space may be reduced compared to a case where air entering the accommodation space is not heated by internal components of the aerosol generating device 100. As a result, heat loss occurring in the heater 130 may be reduced.

FIG. 4 is a cross-sectional view schematically illustrating an aerosol generating device according to another embodiment.

Referring to FIG. 4, an aerosol generating device 100 may include air inlets 142 through which external air flows, a through hole 151 formed in a base 151 and communicating with an interior of an accommodation space, and a blocking wall 180.

A housing 140 may include the air inlets 142 formed around an opening 141. External air flowing into the aerosol generating device 100 may flow into the housing 140 through the air inlets 142. The air inlets 142 may have rectangular cross sections and be spaced apart from each other at regular intervals. However, the number, shape, and position of air inlets 142 are not limited to the examples described above and may be applicable without limitation as along as air is introduced from the outside of the housing 140 into the housing 140. For example, cross-sectional shapes of the air inlets 142 may be circular.

The base 151 may include the through hole 152 that penetrates the base 151. The accommodation space may communicate with the outside through the through hole 152. The air circulation device 160 may be arranged to face the base 151 supporting the heater 130, and airflow generated by the air circulation device 160 may be introduced into the accommodation space through the through hole 152. However, the structure that guides airflow into the accommodation space from the air circulation device 160 is not limited to the example described above. For example, as in the embodiment illustrated in FIG. 3, air may be introduced into the accommodation space through a space between the case 150 and the base 151. Also, although not illustrated in FIG. 4, the case 150 may have a double wall structure including a through hole through which the inner wall communicates with the accommodation space. In this case, air may be introduced between double walls and then introduced into the accommodation space through the through hole of the inner wall.

The aerosol generating device 100 may further include the blocking wall 180 blocking the air flow in the air flow channel 170. As in the embodiment illustrated in FIG. 4, the blocking wall 180 may be arranged such that the air flow channel 170 passes by only a portion of the battery 110. Since the air flow channel 170 passes by a portion of the battery 110, cooling efficiency of the battery 110 may be maintained. Also, although not illustrated in FIG. 4, the blocking wall 180 may be arranged to block between the battery 110 and the controller 120. When the blocking wall 180 is arranged between the battery 110 and the controller 120, although the battery 110 leaks, damage to other components may be prevented.

FIG. 5 is a cross-sectional view schematically illustrating an aerosol generating device according to another embodiment.

Referring to FIG. 5, an aerosol generating device 100 may include a second air inlet 143 through which external air is introduced. The second air inlet 143 is formed at of the bottom of the housing 140. Therefore, an air flow channel 170 may communicate with an accommodation space, and external air may flow from the second air inlet 143. As such, the airflow generated by the air circulation device 160 may be guided into the accommodation space after passing by the battery 110 and the controller 120.

However, the position of the second air inlet 143 is not limited to the example described above. For example, the second air inlet 143 may be formed in an outer circumferential surface of the housing 140 such that air introduced through the second air inlet 143 flows into the accommodation space from the second air inlet 143 after passing by the battery 110 and the controller 120.

FIG. 6 is a perspective view schematically illustrating a detachable air circulation device according to an embodiment. FIG. 7 is a perspective view schematically illustrating a detachable air circulation device according to another embodiment.

Referring to FIGS. 6 and 7, an air circulation device 160 may be detached from an aerosol generating device 160.

Also, the air circulation device 160 may be a sub-assembly including a terminal (not shown) for receiving power. When the air circulation device 160 is assembled into the aerosol generating device 100, the terminal of the air circulation device 160 may be electrically connected to the aerosol generating device 100 to be supplied with power from a battery 110.

Therefore, the air circulation device 160 may be assembled into the aerosol generating device 100 to adjust the amount of air supplied to an accommodation space. Also, after completing the use of the aerosol generating device 100, the user may detach the air circulation device 160 from the aerosol generating device 100. For example, when the air circulation device 160 needs to be replaced, the user may detach the air circulation device 160 from the aerosol generating device 100 and assemble a new air circulation device 160 into the aerosol generating device 100.

As illustrated in FIG. 6, a housing 140 may include an insertion opening 144 through which the air circulation device 160 may be inserted. Also, the housing 140 may include a cover 145 that opens or closes the insertion opening 144. The user may open the cover 145 and assemble the air circulation device 160 into the aerosol generating device 100 through the insertion opening 144 or detach the air circulation device 160 from the aerosol generating device 100 through the insertion opening 144.

As illustrated in FIG. 7, the aerosol generating device 100 may include a plurality of sub-assemblies. For example, the plurality of sub-assemblies may include a first sub-assembly 300, a second sub-assembly 400, and a third sub-assembly 500. Also, the first sub-assembly 300 may include a heater heating a cigarette to generate aerosol, a base supporting the heater, and a case forming an accommodation space accommodating at least a portion of the cigarette. The second sub-assembly 400 may include an air circulation device generating airflow. The third sub-assembly 500 may include a battery that supplies power to the heater and the air circulation device, and a controller that controls operations of the heater and the air circulation device.

The first, second, and third sub-assemblies 300, 400, and 500 may respectively include connection portions to be assembled with one another. For example, the first sub-assembly 300 may include a first male connection portion 310 for coupling with a first female connection portion 405 of the second sub-assembly 400. Also, the second sub-assembly 400 may include a second male connection portion 410 for coupling with a second female connection portion 505 of the third sub-assembly 500. For example, the first male connection portion 310 and the second male connection portion 410 may respectively have screw surfaces capable of engaging with the first female connection portion 405 and the second female connection portion 505, respectively. Alternatively, the first male connection portion 310, the second male connection portion 410, the first female connection portion 405, and the second female connection portion 505 may have interference fit structures.

The first, second, and third sub-assemblies 300, 400, and 500 may be electrically connected to one another when assembled together. For example, the first, second, and third sub-assemblies 300, 400, and 500 may respectively include terminals arranged in the same position to be electrically connected to one another when assembled with one another. Also, air flow passages may be in fluid communication between the first, second, and third sub-assemblies 300, 400, and 500. For example, when the first, second, and third sub-assemblies 300, 400, and 500 are assembled with one another, the air flow passages respectively formed in the first, second, and third sub-assemblies 300, 400, and 500 may be formed in positions corresponding to one another to be in fluid communication with one another.

Therefore, the aerosol generating device 100 may operate not only when the first sub-assembly 300, the second sub-assembly 400, and the third sub-assembly 500 are assembled together but also when only the first sub-assembly 300 and the third sub-assembly 500 are assembled without the second sub-assembly 400. The number, functions, types, and the like of sub-assemblies are not limited to the example described above. Therefore, in addition to the elements described above, other elements may be included in sub-assemblies without limitation.

FIG. 8 is a cross-sectional view schematically illustrating a structure of an air circulation device, according to an embodiment.

Referring to FIG. 8, an insertion space in which an air circulation device 160 may be inserted and accommodated may be formed inside a housing 140.

The insertion space may include a fixing portion for fixing the air circulation device 160. For example, the fixing portion may include a protrusion 146 formed inside the housing 140. In the embodiment illustrated in FIG. 8, the protrusions 146 has a shape extending along the longitudinal direction of the aerosol generating device 100 but is not limited to the shape described above. For example, the protrusion 146 may have a shape extending along an inner circumferential surface perpendicular to the longitudinal direction of the aerosol generating device 100 or may have a shape protruding at one point.

The air circulation device 160 may include a groove 161 having a shape corresponding to the protrusion 146 of the housing 140. The protrusion 146 of the housing 140 and the groove 161 of the air circulation device 160 may engage with each other, and thus, the circulation device 160 may be fixed in the insertion space of the housing 140. The engaging structure of the protrusion 146 and the groove 161 is not limited to FIG. 8 and the embodiment described above. For example, a groove may be formed in the housing 140 and a protrusion engaging with the groove of the housing 140 may be formed at the air circulation device 160 such that the air circulation device 160 may be fixed in the insertion space of the housing 140.

When an outer surface of the air circulation device 160 and an inner surface of the housing 140 have a surface contact, vibration or noise generated by an operation of the air circulation device 160 may be transmitted to the aerosol generating device 100 through the housing 140. Therefore, to reduce the vibration that may be generated by the operation of the air circulation device 160 described above, it is desirable that the air circulation device 160 has a point contact or a line contact with the inner surface of the housing 140, rather than a surface contact. Also, the fixing portion may have elasticity. For example, the fixing portion may include a material having elasticity so that the vibration of the air circulation device 160 is attenuated by the fixing portion having elasticity.

FIG. 9 is a perspective view schematically illustrating an aerosol generating system including an aerosol generating device and a cradle, according to an embodiment.

Referring to FIG. 9, an aerosol generating system may include an aerosol generating device 100 and a cradle 1000 that accommodates the aerosol generating device 100 and charges a battery 110 of the aerosol generating device 100.

Here, the structure and effects of the aerosol generating device 100 according to the embodiments are as described above, and thus, detailed descriptions thereof in the overlapping range will be omitted.

In an aerosol generating system according to an embodiment, the aerosol generating device 100 may be accommodated in the cradle 1000 and charged. Here, the cradle 1000 may include a charging power source 1100 therein, and the aerosol generating device 100 may be inserted into the cradle 1000 and electrically connected to the charging power source 1100 of the cradle 1000. Thereafter, the battery 110 of the aerosol generating device 100 may be charged by the charging power source 1100 of the cradle 1000.

The cradle 1000 may include an internal space 1200 capable of accommodating the aerosol generating device 100. Also, the cradle 1000 may include a second air circulation device 1300 and a second air flow channel 1400. As in the aerosol generating device 100 according to the embodiments described above, the second air circulation device 1300 may be arranged in the second air flow channel 1400 to generate airflow along the second air flow channel 1400. Air flowing through the second air flow channel 1400 may be introduced from the outside through a third air inlet 1410.

Similar to the embodiment illustrated in FIG. 5, the aerosol generating device 100 may include a second air inlet 143 through which external air is introduced. The second air inlet 143 is formed at an end (e.g., the bottom) of the aerosol generating device 100, which is opposite to an end having an opening of a housing 140. However, the aerosol generating device 100 does not include the air circulation device 160 unlike the embodiment illustrated in FIG. 5.

When the aerosol generating device 100 is accommodated in the cradle 1000, the second air inlet 143 may communicate with the second air flow channel 1400, and airflow generated by the second air circulation device 1300 may be introduced into the inside of the housing 140 of the aerosol generating device 100 through the second air inlet 143. The air introduced into the aerosol generating device 100 may flow into an accommodation space after passing by a battery 110 and a controller 120, through an air flow channel 170.

A heater 130 of the aerosol generating device 100 may be heated when the aerosol generating device 100 is coupled to the cradle 1000. Although not illustrated in FIG. 9, the aerosol generating device 100 may be tilted inside the cradle 1000. In other words, the aerosol generating device 100 may be inclined at a preset angle in the cradle 1000. Here, a portion including the second air circulation device 1300 and the second air flow channel 1400 may also be tilted together with the aerosol generating device 100.

When the aerosol generating device 100 is coupled to the cradle 1000, the second air circulation device 1300 may operate to adjust the amount of air supplied to the accommodation space. Also, after the use is completed, only the second air circulation device 1300 may operate to ventilate the accommodation space of the aerosol generating device 100 to maintain cleanliness.

At least one of the components, elements, modules or units (collectively "components" in this paragraph) represented by a block in the drawings such as the controller 120 and the air circulation device 160 may be embodied as various numbers of hardware, software and/or firmware structures that execute respective functions described above, according to an example embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above example embodiments may be implemented in algorithms that execute on one or more processors. Further-more, the components represented by a block or processing steps may employ any number of related art techniques for electronics configuration, signal processing and/or control, data processing and the like.

While the configurations and characteristics of the present disclosure have been particularly shown and described with reference to embodiments of the present disclosure, the present disclosure is not limited to the embodiments, and it may be apparent to those of ordinary skill in the art that various changes or modifications may be made therein within the spirit and scope of the present disclosure. Therefore, it is revealed that such changes or modifications are within the scope of the appended claims.

What is claimed is:

1. An aerosol generating device comprising:

a housing having an opening into which an aerosol generating article to be inserted and comprising a cavity formed therein;

a heater heating the aerosol generating article to generate aerosol;

an air flow channel in fluid communication with outside of the housing and supplying air from the opening of the housing to the aerosol generating article; and an air circulation device arranged in the air flow channel, generating airflow in the air flow channel, and adjusting an amount of air supplied from the air flow channel to an accommodation space accommodating at least a portion of the aerosol generating article.

2. The aerosol generating device of claim 1, further comprising:

a base that supports the heater; and a case arranged in the cavity to form the accommodation space accommodating the base, wherein the air flow channel provides fluid communication between the outside of the housing and the accommodation space.

3. The aerosol generating device of claim 2, wherein the air circulation device is arranged to face the base to generate airflow toward the accommodation space.

4. An aerosol generating device, comprising:

a housing having an opening into which an aerosol generating article to be inserted and comprising a cavity formed therein;

a heater heating the aerosol generating article to generate aerosol;

an air flow channel in fluid communication with outside of the housing and supplying air to the aerosol generating article;

an air circulation device arranged in the air flow channel and generating airflow in the air flow channel;

a base that supports the heater; and a case arranged in the cavity to form an accommodation space accommodating the base and at least a portion of the aerosol generating article, wherein the air flow channel provides fluid communication between the outside of the housing and the accommodation space, wherein the air circulation device is arranged to face the base to generate airflow toward the accommodation space, and wherein the air flow channel comprises:

an air inlet formed around the opening of the housing; and an air flow passage providing fluid communication between the air inlet and the air circulation device.

5. The aerosol generating device of claim 1, further comprising:

a battery supplying power to the heater and the air circulation device; and a controller controlling the heater and the air circulation device, wherein the air flow channel comprises an air flow passage passing by the battery and the controller.

6. The aerosol generating device of claim 5, wherein the air flow channel further comprises an air inlet formed at an end of the housing, which is opposite to an end having the opening.

7. The aerosol generating device of claim 1, further comprising:

a battery supplying power to the heater and the air circulation device; and a controller controlling the heater and the air circulation device independently.

8. An aerosol generating device, comprising:

a housing having an opening into which an aerosol generating article to be inserted and comprising a cavity formed therein;

a heater heating the aerosol generating article to generate aerosol;

an air flow channel in fluid communication with outside of the housing and supplying air to the aerosol generating article; and an air circulation device arranged in the air flow channel and generating airflow in the air flow channel, wherein the air circulation device is a sub-assembly detachable from the aerosol generating device and comprising a terminal receiving power from the aerosol generating device, and wherein, based on the air circulation device being coupled to the aerosol generating device, the aerosol generating device is electrically connected to the terminal of the air circulation device such that power is supplied to the air circulation device.

9. The aerosol generating device of claim 8, wherein the housing comprises an insertion opening, and wherein the air circulation device is assembled into or disassembled from the aerosol generating device through the insertion opening.

10. The aerosol generating device of claim 1, wherein the housing comprises an internal space accommodating the air circulation device, the internal space comprises a fixing portion fixing the air circulation device, the fixing portion comprises one of a protrusion supporting the air circulation device and a groove engaging with the protrusion, and the air circulation device comprises the other one of the protrusion and the groove.

11. The aerosol generating device of claim 2, further comprising an extractor arranged in the accommodation space and detachable from the accommodation space, wherein the air circulation device is located between the extractor and the base to supply air into the extractor.

12. An aerosol generating device comprising:

a first sub-assembly comprising:

a first male connection portion;

a first housing having an opening through which an aerosol generating article is to be inserted; and a heater heating the aerosol generating article to generate aerosol;

a second sub-assembly comprising:

a first female connection portion for coupling with the first male connection portion of the first sub-assembly;

a second male connection portion; and an air circulation device generating airflow; and a third sub-assembly comprising:

a second female connection portion for coupling with the second male connection portion of the second sub-assembly;

a battery supplying power to the heater and the air circulation device; and a controller controlling the heater and the air circulation device, wherein, based on the first, second, and third sub-assemblies being assembled with one another, the first, second, and third sub-assemblies are electrically connected to one another and form an air flow channel in fluid communication with outside of the aerosol generating device such that air is supplied to the aerosol generating article through the air flow channel, and wherein the air circulation device is arranged in the air flow channel to generate air flow in the air flow channel.

13. An aerosol generating system comprising:

an aerosol generating device; and a cradle accommodating the aerosol generating device and charging a battery of the aerosol generating device, wherein the aerosol generating device comprises:

a housing having an opening through which an aerosol generating article is to be inserted and comprising a cavity formed therein;

a heater heating the aerosol generating article to generate aerosol;

a first air flow channel in fluid communication with outside of the housing to supply air to the aerosol generating article, and wherein the cradle comprises:

a second air flow channel in fluid communication with the first air flow channel of the aerosol generating device; and an air circulation device arranged in the second air flow channel to generate airflow in the first air flow channel.

14. The aerosol generating system of claim 13, wherein the aerosol generating device further comprises:

a base supporting the heater; and a case arranged in the cavity to form an accommodation space accommodating the base and at least a portion of the aerosol generating article, and wherein the first air flow channel provides fluid communication between the second air flow channel and the accommodation space.

15. The aerosol generating system of claim 14, wherein the aerosol generating device further comprises:

a battery supplying power to the heater and the air circulation device; and a controller controlling the heater and the air circulation device, wherein the first air flow channel comprises:

an air inlet formed at an end of the housing, which is opposite to an end having the opening; and an air flow passage communicating with the air inlet and an interior of the accommodation space, and wherein the air flow passage passes by the battery and the controller.

* * * * *